US008573366B2

(12) United States Patent
Elomaa et al.

(10) Patent No.: US 8,573,366 B2
(45) Date of Patent: Nov. 5, 2013

(54) ELEVATOR SYSTEM TO EXECUTE ANTICIPATORY CONTROL FUNCTION AND METHOD OF OPERATING SAME

(75) Inventors: Niko Elomaa, Hyvinkää (FI); Jukka-Pekka Sarjanen, Vantaa (FI); Tuomas Susi, Helsinki (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/293,616

(22) Filed: Nov. 10, 2011

(65) Prior Publication Data

US 2012/0090922 A1 Apr. 19, 2012

Related U.S. Application Data

(63) Continuation of application No. PCT/FI2010/000040, filed on Jun. 2, 2010.

(30) Foreign Application Priority Data

Jun. 3, 2009 (FI) ..... 20090226

(51) Int. Cl.
*B66B 1/18* (2006.01)

(52) U.S. Cl.
USPC ..... 187/387; 187/392

(58) Field of Classification Search
USPC ..... 187/380–388, 391–393, 396
See application file for complete search history.

(56) References Cited

U.S. PATENT DOCUMENTS

| | | | | |
|---|---|---|---|---|
| 3,967,702 | A | 7/1976 | Iwaska et al. | |
| 5,511,635 | A * | 4/1996 | Kameli | 187/392 |
| 5,689,094 | A * | 11/1997 | Friedli et al. | 187/384 |
| 6,202,799 | B1 * | 3/2001 | Drop | 187/388 |
| 6,209,685 | B1 | 4/2001 | Zaharia et al. | |
| 6,257,373 | B1 | 7/2001 | Hikita et al. | |
| 7,328,775 | B2 * | 2/2008 | Zaharia et al. | 187/396 |
| 7,353,915 | B2 * | 4/2008 | Zaharia et al. | 187/388 |
| 7,559,408 | B2 * | 7/2009 | Flynn et al. | 187/396 |
| 7,581,622 | B2 * | 9/2009 | Amano | 187/384 |
| 7,729,691 | B2 * | 6/2010 | Newville | 455/420 |
| 7,793,762 | B2 * | 9/2010 | Zaharia et al. | 187/396 |
| 7,823,700 | B2 * | 11/2010 | Boss et al. | 187/384 |
| 8,020,672 | B2 * | 9/2011 | Lin et al. | 187/392 |
| 8,028,806 | B2 * | 10/2011 | Stanley et al. | 187/387 |
| 8,047,333 | B2 * | 11/2011 | Finschi | 187/382 |
| 8,061,485 | B2 * | 11/2011 | Finschi | 187/384 |
| 2004/0188185 | A1 * | 9/2004 | Pieper | 187/391 |
| 2008/0217112 | A1 | 9/2008 | Puskala et al. | |

FOREIGN PATENT DOCUMENTS

| | | | |
|---|---|---|---|
| EP | 0452130 | A2 | 10/1991 |
| EP | 0968953 | A1 | 1/2000 |
| WO | WO-00/75062 | A1 | 12/2000 |
| WO | WO-2007/026042 | A2 | 3/2007 |

OTHER PUBLICATIONS

International Search Report

* cited by examiner

*Primary Examiner* — Anthony Salata

(74) *Attorney, Agent, or Firm* — Harness, Dickey & Pierce, P.L.C.

(57) ABSTRACT

In a method for controlling an elevator system, hints relating to potential elevator passengers are received from at least one observation point connected to the elevator system. Based on the hints, forecasts relating to potential elevator passengers are prepared, on the basis of which forecasts one or more anticipatory control actions are executed.

16 Claims, 1 Drawing Sheet

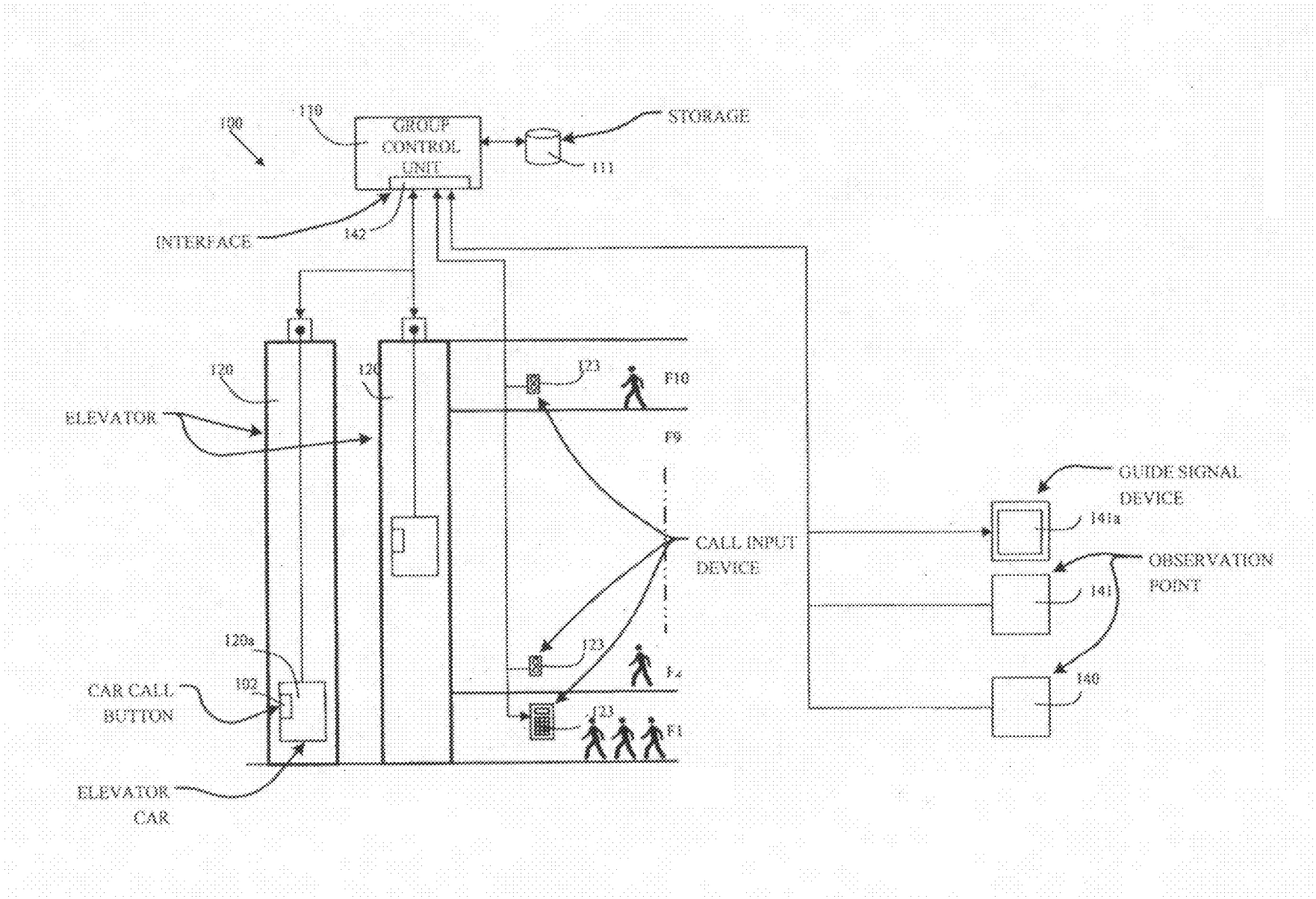
GUIDE SIGNAL DEVICE
OBSERVATION POINT
149a
149
149
STORAGE
111
CALL INPUT DEVICE
F10
F9
F2
F1
123
123
123
GROUP CONTROL UNIT
110
140
100
INTERFACE
120
120a
122
ELEVATOR
CAR CALL BUTTON
ELEVATOR CAR

ELEVATOR SYSTEM TO EXECUTE ANTICIPATORY CONTROL FUNCTION AND METHOD OF OPERATING SAME

CROSS-REFERENCE TO RELATED APPLICATIONS

This is a Continuation of PCT/FI2010/000040 filed on Jun. 2, 2010 which is an International Application claiming priority from FI 20090226 filed on Jun. 3, 2009, the entire contents of which are hereby incorporated by reference.

FIELD OF THE INVENTION

The invention relates to elevator systems. In particular, the invention relates to the utilization of hints indicating future traveling actions in an elevator system.

BACKGROUND OF THE INVENTION

In elevator systems, calls are traditionally input using up/down buttons in the elevator waiting halls and car call buttons in the elevator cars. There is also an increasing trend to use so-called destination call systems, wherein each passenger inputs a personal destination floor call already in the waiting hall before entering an elevator car. The calls input by passengers are allocated in the elevator group control system by comparing different passenger route alternatives to each other and allocating the calls to the elevators so that the calls are served in a way that will optimize a characteristic or a combination of characteristics descriptive of the service provided by the elevator group. Allocation can be improved by applying in different traffic situations optimization criteria that are best suited for the traffic situation in question and/or by activating a so-called zoned operation mode, wherein the building floors are divided into zones comprising one or more floors and served by certain elevators of the elevator system.

These measures are designed to allow the elevator system to adapt itself to the prevailing traffic situation, such as e.g. up-peak traffic in the building. In order to forecast traffic situations or traffic types and traffic intensities, statistics are collected about traveling actions in the elevator system according to different times of the day and days of the week and, based on the statistical data thus collected, the traffic situation in the elevator system at each instant of time is forecast. There are also prior-art solutions wherein the times of arrival of passengers at the elevators serving them are forecast on the basis of the location of the call input device and control decisions are made on the basis of the forecasted time of arrival.

In today's elevator systems, elevators can be driven to floors by calls, by parking and congestion-mode return commands. Calls, regardless of whether they are car calls, destination calls, floor calls etc., are "strong commands" which are always executed. Parking commands are "weak commands" which are based on parameters or traffic statistics and which are used to move vacant elevators beforehand to floors from which passenger traffic is expected in the near future. Parking is a "weak command" because, when an actual call is received, the parking command is either transferred to another elevator or, if all the elevators have a call to be served, removed altogether. A congestion-mode return command is a "weak command" like parking, the purpose of which is to move elevators to a floor which at the moment is likely to be crowded by so many passengers that they can not be served by a single elevator.

The above-described prior-art solutions for forecasting future passenger traffic are based on parametrization, statistical data and calls already entered, and they are thus hardly capable of anticipating future passenger traffic at an early enough stage to allow optimal control decisions to be made. Traffic statistics are long-time averages, and consequently forecasts of future passenger traffic made on the basis of them are inaccurate, especially if there occur unexpected and fast changes in passenger traffic. There is therefore a need for solutions in which changes in passenger traffic can be anticipated in good time and an influence can be exerted on the elevator system's control decisions before the elevator system starts receiving calls caused by the forecasted passenger traffic and transporting passengers to their destination floors.

OBJECT OF THE INVENTION

The object of the present invention is to eliminate or at least reduce the drawbacks involved in the above-described prior-art solutions. A further object of the invention is to achieve one or more of the following aims:

- a solution that will improve the transport capacity of an elevator system, shorten passenger waiting times and reduce congestion in elevator lobbies,
- a solution that will allow reliable and timely adaptation of an elevator system to different traffic situations and thus enable it to provide improved service to passengers using the elevator system,
- a solution wherein passengers can be guided in good time to the serving elevator or elevator group so as to distribute the transport capacity of the elevator system between different elevators and elevator groups and to avoid congestion in waiting halls,
- a solution in which it is possible to utilize data transmitted by other systems in the building, such as e.g. other transport systems, in order to anticipate future passenger traffic,
- a solution in which it is possible to anticipate the joint effect on passenger traffic of passenger flows arriving from several different observation points.

BRIEF DESCRIPTION OF THE INVENTION

The method of the invention is characterized by what is disclosed in the characterizing part of claim 1. The elevator system of the invention is characterized by what is disclosed in the characterizing part of claim 9. Other embodiments of the invention are characterized by what is disclosed in the other claims. Inventive embodiments are also presented in the description part and drawings of the present application. The inventive content disclosed in the application can also be defined in other ways than is done in the claims below. The inventive content may also consist of several separate inventions, especially if the invention is considered in the light of explicit or implicit sub-tasks or with respect to advantages or sets of advantages achieved. In this case, some of the attributes contained in the claims below may be superfluous from the point of view of separate inventive concepts. The features of different embodiments of the invention can be applied in connection with other embodiments within the scope of the basic inventive concept.

The present invention discloses a method for controlling an elevator system. In the method, hints are received from at least one observation point connected to the elevator system and, based on said hints, forecasts relating to potential elevator passengers are made. Based on the forecasts, one or more anticipatory control actions are performed in the elevator system. In this connection, 'anticipatory control action' refers to a control action which is executed as far as possible before the traveling actions generated by the potential elevator passengers associated with the hint, in other words, before the elevator calls entered by the potential elevator passengers and/or before such passengers enter the elevator cars serving them. The forecasts determine e.g. the number of potential elevator passengers, the waiting hall that the potential elevator passengers will presumably use, a probable duration of transit from the observation point to the waiting hall in question, and a probable target floor for the potential elevator passengers. The observation point is preferably integrated in conjunction with a system already existing in the building, e.g. with an automatic door, a turngate, an access control system, a public transportation means, another elevator system, etc. Different observation points may transmit different types of hints, depending on the nature of the observation points.

In an embodiment of the invention, temporal statistical information is collected from hints received and from traveling actions having taken place. Based on the statistical information thus collected, at least one forecast parameter is defined, which parameter is used for making forecasts relating to potential elevator passengers. Anticipatory control actions include e.g.: recording a hint for later utilization; adjusting an earlier hint; ordering one or more elevator cars to an anticipated elevator lobby; and activating emergency mode of the elevator system. It is also possible to select in the elevator system a primary waiting hall, elevator or elevator group to serve the potential elevator passengers, and the potential elevator passengers can be guided from the observation point to the selected target.

In an embodiment of the invention, hints relating to potential elevator passengers are received from two or more observation points. On the basis of the hints, overall forecasts relating to potential elevator passengers are produced and, based on said forecasts, one or more of the control actions to be executed are selected.

In an embodiment of the invention, the forecasts related to one or more hints are updated after receipt of the hint, and one or more anticipatory control actions are executed on the basis of the updated forecasts. In an embodiment of the invention, the forecasts related to a hint are updated on the basis of another hint obtained from one of the observation points.

The present invention also discloses an elevator system comprising one or more elevator groups. The elevator system is connected via an interface to at least one observation point to receive hints relating to potential elevator passengers. The elevator system is arranged to produce forecasts relating to potential elevator passengers on the basis of the hints received and to execute anticipatory control actions on the basis of said forecasts.

The solution of the invention provides several advantages as compared to prior-art solutions. As the elevator system carries out anticipatory control actions in good time before the potential elevator passengers arrive at the elevators, the transport capacity of the elevator system can be better optimized, passenger waiting times can be shortened and in general better transport service can be provided to passengers. The elevator system can also prepare itself for future congested conditions in good time and adapt to different traffic situations more correctly and reliably than before. By combining the information obtained from different observation points, forecasts can be made about the combined effects of passenger flows, and optimal control actions can be selected on the basis of the predicted combined effect. In the solution of the invention, it is also possible to make conclusions as to the elevators and elevator groups that will best serve potential elevator passengers in each situation and to guide the passengers to those elevators and elevator groups already at the observation point, thus facilitating and accelerating their travel. Such guidance makes it possible to equalize the transport capacity of the elevator system between different elevator groups and to guide elevator passengers to non-congested waiting halls when necessary. The observation points can be preferably integrated with other systems of the building, thus achieving a cost-effective solution. As the hints are categorized into different types, observation points can be easily integrated in widely varying systems and the information produced by them can be used as hint data.

LIST OF FIGURES

In the foregoing, the invention will be described in detail by referring to embodiment examples, wherein:

FIG. 1 represents an elevator system in which the method of the invention is applied.

DETAILED DESCRIPTION OF THE INVENTION

Below, the meanings of certain terms used in the present application are explained:

- travel action: This term refers to a call entered by a passenger in a waiting hall or elevator car and to the movement of a person into or out of an elevator car;
- congestion mode: An elevator system control method wherein the transport capacity of the elevator system is optimized e.g. by minimizing travel time at the expense of waiting time and/or by shifting into zoned operation, wherein the floors to be served are distributed between different elevators;
- potential elevator passenger: a person who is moving in the building or about to enter the building and who will probably use elevators but has not yet input an elevator call or entered an elevator car.

FIG. 1 represents an elevator system 100 in which the method of the invention is applied. The elevator system comprises an elevator group consisting of a number of elevators 120. The operation of the elevators is coordinated by a group control unit 110, which allocates the elevators 120*a* for use by passengers on the basis of calls entered and elevator group status data. The elevator cars 120*a* are provided with car call buttons 102 for the entry of destination in the elevator car. The elevator lobby on each floor F1-F10 is provided with a call input device 123. The call input device 123 on floor F1 is a destination call panel, whereas the devices on the other floors are traditional up/down buttons. The call input devices 123 can also be chosen in a way different from that proposed in FIG. 1, for example so that all the call input devices 123 are exclusively up/down buttons or exclusively destination call panels.

The group control system 110 comprises a set of software programs which, when executed in a processing unit, carries out the steps of the method of the invention. Storage means 111 are provided to enable the traveling actions associated with elevator trips and the anticipatory information (hints) sent by observation points to be stored and statistically classified for later use. To detect passenger transfers, i.e. passengers entering and leaving the elevator cars when the elevators stop at landings, the elevator system uses data obtained from the car load weighing devices of the elevator cars and from door photocells.

In FIG. 1, reference numbers 140 and 141 denote by way of example two observation points, which are connected via an interface 142 to the group control system 110 for the reception of hints sent by the observation points. Provided in conjunction with observation point 141 is a guide signal device 141*a*, which can be used to guide passengers from the observation point 141 to a given waiting hall, to a given elevator, and/or, if there are several elevator groups in use in the building, to a given elevator group. The guide signal device is connected to the interface 142 to allow guidance information to be transmitted from the group control system to the guide signal device 141*a*. The guide signal device is e.g. an indicator board on which it is possible to display information to people passing by the observation point, telling them which elevator and/or waiting hall and/or elevator group they should use. By employing guidance, it is possible to distribute the transport capacity of the elevator system evenly between different elevators and/or elevator groups and to avoid the occurrence of congested situations in waiting halls.

Observation point 140 is integrated e.g. in conjunction with an escalator and observation point 141 in conjunction with an automatic door leading into the entrance lobby F1 of the building. A sensor, e.g. a photocell, at observation point 141 detects persons coming through the automatic door into the entrance lobby of the building, whereas a sensor, e.g. a photocell, at observation point 140 detects persons traveling on the escalator towards a given waiting hall in the elevator system. Observation points can also be integrated in conjunction with other systems in the building, such as e.g. turngates and other gates. An observation point may also consist in an access control system, which transmits to the elevator system information about the arrival of a potential elevator passenger as the latter is asking for permission to enter the building or a part of it. Another possibility is that one of the elevator groups in the building transmits hints regarding potential elevator passengers to another elevator group. In addition, it is possible to install in the building specific monitors, such as e.g. approach control radars, cameras and other corresponding apparatus, which transmit hints about potential elevator passengers to the elevator system. Observation points can also be integrated in public transport means, and hints about potential elevator passengers can be transmitted when the transport means are arriving or have already arrived at stops on the building premises.

In FIG. 1, the functions of the method of the invention are integrated in the group control system 110, but they can also be integrated in a separate apparatus which, in addition to the aforesaid software and the aforesaid storage means, comprises the aforesaid interface for receiving the hints sent by the observation points and which is connected via an appropriate data transmission link to the group control system of the elevator system to allow the transmission of the required status data and control commands between the apparatus and the group control system. It is also possible to divide the said functions among several different apparatus and/or group control systems.

As stated above, each observation point transmits to the elevator system hints relating to potential elevator passengers, allowing the elevator system to anticipate future traveling actions on the basis of the hints and to draw conclusions as to the required control actions. Different observation points may transmit to the control system different types of hints depending on the nature of the observation point. The type of the hint may be determined e.g. according to which observation point has sent the hint, or the type of the hint may be associated with the hint data if the observation point can generate hints of several different types. In the following, a few examples of possible hint types are described. An essential feature of all hint types is that the elevator system is able to create forecasts relating to potential elevator passengers on the basis of the hints regardless of the hint type:

event hint: an event-type hint, which indicates a particular event, e.g. the arrival of a public transport means at a stop on the building premises, starting of an escalator, opening of a turngate, etc. The elevator system estimates the number of potential elevator passengers associated with the event e.g. on the basis of forecast parameters stored in the elevator system;

general hint: contains information regarding the number of persons detected at an observation point within a given period of time. For example, an observation point located at a door leading into the entrance lobby of the building transmits data regarding the number of persons having entered the building to the elevator system e.g. once in every ten seconds;

individualized hint: contains data regarding a potential passenger's probable starting floor (waiting hall) and/or probable destination floor and/or extra data about the passenger, e.g. physical disability. The hint comprises either the aforesaid information directly or an ID code on the basis of which the elevator system can indirectly determine the said information. For example, an access control system sends an ID code identifying the person to the elevator system when the person is asking for access into the building or a part of it using a personal electric identifier in which the said ID code is stored. Based on the ID code, the elevator system determines passenger-specific data, such as e.g. the destination floor to which the passenger is likely to be traveling.

When the elevator system has received a hint from an observation point, it determines the number of potential elevator passengers associated with the hint. As it is to be assumed that, for example, not all the people arriving in the entrance lobby will use elevators, at least one forecast parameter indicating the probability with which the persons passing by a given observation point will use elevators is stored in the elevator system separately for each observation point. Multiplying the number of people detected at the observation point by the said forecast parameter yields the number of potential elevator passengers associated with the hint. The forecast parameters are either constant or dynamically time-dependent, for example so that different forecast parameters are used on different days of the week and/or at different times of the day. The forecast parameters are either manually input to the elevator system or their value is derived on the basis of stored statistical data.

As the elevator system knows which observation point has sent the hint, it is able to anticipate the probable destination floor (waiting hall) of the potential elevator passengers as well as their travel time from the observation point to the anticipated waiting hall. For this purpose, information regarding average travel times from the observation point to one or more waiting halls is stored in the elevator system specifically for each observation point. The anticipated travel time may be defined taking into account physical disability and other special requirements relating to the potential elevator passenger. On the basis of the travel time is obtained a forecast of the arrival time or a time window within which the potential elevator passengers are likely to reach the anticipated waiting hall. On the basis of the number of potential elevator passengers and the estimated arrival time, a weight value is calculated for each hint, which value is the higher the larger the number of potential elevator passengers and the closer the temporal proximity of the arrival time. To determine the control actions, the hints are categorized e.g. on the basis of their weight values. Such categories are e.g. weak hint, medium strong hint and strong hint, each category determining at least one control action to be executed after receipt of the hint. The control actions may be selected by taking into account, in addition to the weight value of the hint, the actual traffic situation prevailing in the elevator system and/or traffic forecasts based on statistical data.

The forecasts associated with a hint can be determined initially upon receipt of the hint and updated at later stages before the estimated time of arrival. The updating of the hints may be effected e.g. at predetermined time intervals and/or when triggered by a subsequently received hint. Based on the updated hints, the elevator system executes one or more control actions when necessary.

According to an embodiment of the invention, the elevator system receives hints from a plurality of observation points and, based on the hints, prepares overall forecasts relating to potential elevator passengers. For example, if the total number of potential elevator passengers forecasted on the basis of the hints in the same waiting hall and substantially within the same time window is so large that a single elevator car can not serve all the passengers at the same time, then, based on the overall forecast, the elevator system will order several elevator cars to the waiting hall in question.

Below are a few examples of anticipated control actions that the elevator system may execute on the basis of hints received:

- the hint data is recorded but no other actions are performed. The hint is adjusted later on the basis of a hint received from either the same or another observation point;
- one or more elevator cars are ordered automatically to the anticipated waiting hall;
- congestion mode of the elevator system is activated. Congestion mode is activated e.g. when the total number of potential elevator passengers exceeds a given threshold value and at the same time traffic forecasts indicate that congestion has started or will start in the near future. Congestion mode can be activated with a suitable delay from the forecasted moment to avoid premature transition of the elevator system to congestion mode.
- potential elevator passengers are guided to a primary elevator, elevator group and/or waiting hall. For example, when the elevator system discovers that a given elevator group is getting congested and that the transport capacity of another elevator group is simultaneously underutilized, the other elevator group is defined as the primary elevator group to which potential elevator passengers are guided from one or more observation points. Guidance is used to direct potential elevator passengers to a desired target so as to optimize the transport capacity and/or to minimize congestion in the elevator system.

Elevators are brought to different floors by calls and orders. A decision for ordering one or more elevators to a floor is made e.g. in an action module which generates both orders based on parameters and traffic statistics and orders based on external input data and hints. In the action module, statistical data is combined with input data and parameters, and from these are generated "weak commands", which include e.g. parking, returning and removal actions and intermediates of these. The idea is to integrate all speculative ways of ordering elevators to floors to form a single model. For example, if a hint indicates that a subway train is arriving at the station and at the same time traffic statistics indicate the onset of a congestion peak in the elevator system, then a larger number of elevators can be ordered to the subway floor than the number which would be ordered on the basis of the hint data only, or an already existing call can be served by a plurality of elevators or by an elevator carrying fewer passengers.

In the following, a few examples will be presented to describe the application of the invention in conjunction with elevator systems.

Example 1

A passenger arrives by car and stops in front of the door of the parking hall of a building. The arrival of the car is detected by a proximity sensor mounted in conjunction with the door, and the sensor transmits corresponding information (event hint) to the elevator system. The elevator system determines the parking hall floor as the probable waiting hall and defines a time window within which the passenger is likely to arrive in the waiting hall. The elevator system orders an elevator car to the parking hall before expiry of the time window. When the passenger arrives at the parking hall elevators, the elevator reserved for him/her is already waiting there with doors open.

Example 2

A passenger arriving in the parking hall by car is identified from the registration number plate of the car, and this identification data (individualized hint) is sent to the elevator system. On the basis of the identification data, e.g. the registration number of the car, the elevator system determines the destination floor that the passenger is likely to be heading for. The elevator system orders an elevator car to the parking hall. If the elevators serving the parking hall do not serve the assumed destination floor of the passenger, then the hint is also transmitted to another elevator group, which serves the destination floor in question. The other elevator group records the hint and parks an elevator car at a transfer floor, e.g. at the entrance lobby, if there is already a vacant elevator at the entrance lobby. When the passenger comes to the parking hall elevators and inputs a call in the elevator car to the transfer floor, this results in the transmission of an adjusted hint to the said other elevator group, which orders an elevator car to the transfer floor if there is not already an elevator car parked at the transfer floor.

Example 3

A commercial center has several elevator banks and escalators. An event hint is obtained from the escalators when they are started. Statistical information has been collected about traveling actions in the elevator system to produce traffic forecasts. If two or more escalators leading to the same waiting hall are started within a time window defined with sufficient coincidence and traffic forecasts indicate a rush hour, then the elevator system activates congestion mode.

Example 4

A number of people arrive at a stop on the building premises by public transport means, e.g. by bus, subway train, railway train or airplane. The stop is provided with an observation point, e.g. a camera arrangement, which estimates the number of people leaving the transport means and transmits this piece of information as a hint (general hint) to the elevator system. The elevator system determines the number of potential elevator passengers and, based on the forecast, orders one or more elevator cars to the floor at which the stop is located.

Example 5

A building has several elevator banks serving the entrance lobby. Provided in conjunction with the door leading into the entrance lobby are an observation point and a signal device. When the elevator system discovers that the elevator bank closest to the observation point is becoming congested, it guides the potential elevator passengers by means of the signal device to another, less congested elevator bank.

The invention is not exclusively limited to the above-described embodiment examples, but many variations are possible within the scope of the inventive concept defined in the claims.

The invention claimed is:

1. A method for controlling an elevator system including one or more elevator groups, said elevator system being connected to at least one observation point, the method comprising:

receiving hint information relating to potential elevator passengers from the at least one observation point;

preparing, based on the received hint information and a forecast parameter, forecast information relating to the potential elevator passengers, the forecast parameter being associated with the at least one observation point, and being indicative of a probability with which persons passing the at least one observation point are potential elevator passengers; and executing, prior to entry of an elevator call by the potential elevator passengers, one or more anticipatory control actions on the basis of said forecast information.

2. The method according to claim 1, wherein said forecast information is indicative of at least one of: a number of the potential elevator passengers; probable waiting hall of the potential elevator passengers; probable travel time of the potential elevator passengers from the at least one observation point to the probable waiting hall; and probable destination floor of the potential elevator passengers.

3. The method according to claim 1, wherein the hint information is received from two or more observation points, wherein the preparing the forecast information includes preparing overall forecasts relating to the potential elevator passengers based on the hint information, and wherein one or more control actions to be executed are selected based on the overall forecasts.

4. The method according to claim 1, wherein the forecast information is updated after receipt of additional hint information, and one or more control actions are executed on the basis of the updated forecast information.

5. The method according to claim 1, wherein at least one of the one or more anticipatory control actions includes one of:

recording the hint information;

adjusting the hint information;

ordering one or more elevator cars to an anticipated waiting hall; and activating a congestion mode of the elevator system.

6. The method according to claim 1, further comprising:

determining at least one of the elevator, waiting hall and elevator bank as a target to serve potential elevator passengers detected by the at least one observation point; and guiding the potential elevator passengers from the at least one observation point to the determined target.

7. The method according to claim 1, further comprising:

collecting temporal statistical information about received hint information and traveling actions having taken place; and defining the forecast parameter based on the collected temporal statistical information.

8. The method according to claim 1, further comprising:

recognizing a type of the received hint information;

taking the hint information type into account when defining forecasts relating to the potential elevator passengers.

9. An elevator system comprising:

one or more elevator groups, wherein the elevator system is connected via an interface to at least one observation point, the elevator system being configured to receive hint information relating to potential elevator passengers, the elevator system being further configured to generate, based on the received hint information and a forecast parameter, forecast information relating to the potential elevator passengers, and to execute anticipatory control actions on the basis of said forecast information prior to entry of an elevator call by the potential elevator passengers, the forecast parameter is associated with the at least one observation point, and the forecast parameter is indicative of a probability with which persons passing the at least one observation point are potential elevator passengers.

10. The elevator system according to claim 9, wherein said forecast information is indicative of at least one of: a number of the potential elevator passengers; probable waiting hall of the potential elevator passengers; probable travel time of the potential elevator passengers from the at least one observation point to the probable waiting hall; and probable destination floor of the potential elevator passengers.

11. The elevator system according to claim 9, wherein the elevator system is configured to receive hint information from two or more observation points, produce overall forecasts relating to the potential elevator passengers on the basis of the hint information, and to select one or more of the anticipatory control actions to be executed on the basis of said overall forecasts.

12. The elevator system according to claim 9, wherein the elevator system is configured to update the forecast information associated with the hint information after receipt of additional hint information, and to execute one or more control actions on the basis of the updated forecast information.

13. The elevator system according to claim 9, wherein said anticipatory control actions are one of: recording of the hint information; adjusting the recorded hint information; ordering one or more elevator cars to the anticipated waiting hall; and activating a congestion mode of the elevator system.

14. The elevator system according to claim 9, further comprising:

at least one signal device configured to guide the potential elevator passengers from the at least one observation point to at least one of a primary elevator, a waiting hall, and an elevator bank determined by the elevator system.

15. The elevator system according to any claim 9, wherein the elevator system is configured to store temporal statistical information associated with received hint information and traveling actions having taken place, and to define the forecast parameter based on the temporal statistical information.

16. The elevator system according to claim 9, wherein the elevator system is configured to recognize a type of the received hint information, and to define forecasts relating to the potential elevator passengers based on the type of the received hint information.

* * * * *